United States Patent [19]

Bottom et al.

[11] 4,060,888

[45] Dec. 6, 1977

[54] METHOD OF IMPROVING OHMIC CONTACT THROUGH HIGH-RESISTANCE OXIDE FILM

[75] Inventors: Virgil E. Bottom, Abilene, Tex.; Robert E. Christian, Shawnee, Kans.

[73] Assignee: Tyco Filters Division, Inc., Phoenix, Ariz.

[21] Appl. No.: 700,756

[22] Filed: June 29, 1976

[51] Int. Cl.[2] ..... H01R 43/00

[52] U.S. Cl. ..... 29/628; 29/25.35; 219/92

[58] Field of Search ..... 29/25.35, 628, 610, 29/612; 228/199, 201, 179; 219/91, 92, 93, 94, 384, 69 M, 69 R

[56] References Cited

U.S. PATENT DOCUMENTS

| | | | |
|---|---|---|---|
| 2,392,429 | 1/1946 | Sykes | 29/25.35 X |
| 3,634,929 | 1/1972 | Yoshida et al. | 29/628 X |
| 3,666,913 | 5/1972 | Haefling et al. | 29/628 X |
| 3,787,966 | 1/1974 | Klossika | 29/628 |

*Primary Examiner*—Victor A. DiPalma

*Attorney, Agent, or Firm*—Schiller & Pandiscio

[57] ABSTRACT

A novel method is described for improving the ohmic contact through a relatively high electrical-resistance oxide film formed on at least one of two materials joined together to provide a low-resistance electrical junction. A current pulse of sufficient magnitude and duration is directed through the junction so that the oxide film breaks down and so that normal operating currents can then pass through the junction between the two materials.

5 Claims, 5 Drawing Figures

METHOD OF IMPROVING OHMIC CONTACT THROUGH HIGH-RESISTANCE OXIDE FILM

This invention relates to improving conduction through electrical junctions and more particularly to a method of improving ohmic contact through oxide films formed on aluminum surfaces.

Various conducting metals can be used as electrode and contact materials in various electrical and electronic devices, such as integrated and printed circuits, piezoelectric crystal units and the like. These electrode and contact materials are formed in various shapes, depending upon the particular application, and in many cases are in the form of thin films. For example, in printed circuits the entire circuit including the contacts can be provided in the form of single thin layers of electrically conductive material etched to form the particular circuit configuration, while in piezoelectric crystal units thin films of electrically-conductive metal are provided on opposite sides of a piezoid (a piece of piezoelectric crystal).

Of the various metals that can be used as electrode and contact materials for these electrical and electronic devices, the most common include aluminum, gold and silver. Of these, aluminum is usually preferred since it is less expensive. Aluminum is also preferred in acoustical applications (where devices such as crystal resonators and filters are operating at high acoustical frequencies, e.g. 10 mhz) since the aluminum (a) is easy to apply to the piezoid by well-known sputtering or evaporation techniques, (b) adheres to the crystal better than other electrode materials, and (c) has an acoustic impedance which closely matches that of the crystals.

One significant result of using aluminum as an electrode and contact material is that an aluminum oxide layer naturally develops on the aluminum surfaces of the electrodes and contacts. The aluminum oxide layer also can be formed or increased in thickness by anodic oxidation for the purpose of protecting the aluminum from further chemical changes. For example, in the case of piezoelectric crystal units, the aluminum is deposited on the crystal to a thickness of a few hundred to a few thousand Angstrom units by evaporation or sputtering. When the freshly prepared aluminum surface is exposed to air or oxygen, an oxide layer begins to develop on the surface.

The oxide film, which is essentially $Al_2O_3$, grows to a thickness of about 10 Angstroms in about an hour, a thickness of about 25 Angstroms in a day, and a thickness of about 50 Angstroms in a month. After this period the rate of growth of the oxide is extremely small. The oxide layer can, however, affect the operation of the particular device. In piezoelectric crystal units this oxide film tends to reduce the resonant frequency of the crystal. For example, the resonant frequency of a freshly made 47 mhz third overtone AT-cut quartz resonator may be expected to decrease by about 2.5 khz due to formation of an oxide film having a maximum thickness of about 50 Angstroms. Once the oxide film has formed, the resonant frequency usually stabilizes. The oxide layer is usually taken into account when manufacturing piezoelectric crystal units for a particular resonant frequency.

A serious problem, however, is provided by the oxide film. Since aluminum oxide is a relatively poor electrical conductor, the formation of the oxide film will also effect the electrical conduction between the aluminum electrode or contact and the material to which it is joined. In the case of piezoelectric crystal units, an electrically-conductive cement is typically provided between the aluminum electrodes and the supporting structure for not only providing electrical contact between the electrodes and structure, but also to provide mechanical support for the crystal. The oxide layer which forms on the aluminum surface, either by natural exposure to air or oxygen or by anodizing the aluminum surface, provides a high electrical resistance barrier between the aluminum electrode and the cement, and this effectively degrades the quality of the device and may even render it inoperative.

Prior to the present invention, it was customary to penetrate the insulating barrier formed by the aluminum oxide film by scribing or scratching the aluminum oxide to expose the aluminum surface therebelow so that ohmic contact could be made with the aluminum. However, this approach is not satisfactory since in the course of scraping off the aluminum oxide, portions of the aluminum metal also may be scraped off, with the result that an insufficient amount of aluminum may remain for contact or electrode purposes, particularly where the aluminum was applied as a thin film. The contact or electrode thus formed may prove to be unreliable. Further, when the aluminum forms an electrode of a piezoelectric crystal unit, scraping the oxide film may subject the crystal to stresses which could result in crystal fracture and breakage.

It is therefore an object of the present invention to improve the electrical conductivity through an electrically-insulating oxide film.

Another object of the present invention is to provide a method of simply and quickly improving the electrical-conduction path through an electrical junction between two materials, at least one of which is made of aluminum having an aluminum oxide film formed thereon.

Still another object of the present invention is to provide a method of reducing the high resistance effects provided by an aluminum oxide film formed on aluminum electrodes without the need of mechanically scraping the aluminum oxide film.

Yet another object of the present invention is to provide a novel method of treating aluminum electrodes of piezoelectric crystal units to reduce high resistance effects attributed to metal surface oxide formations, the method having the advantages of not requiring expensive apparatus or extensive modification of the manufacturing operations involved in making such devices.

These and other objects are achieved by providing a current pulse of sufficient magnitude and duration through a junction formed by two materials, at least one of which is made of a metal having a high resistance oxide film, so that the oxide film breaks down and the ohmic contact through the oxide film is improved, and so that normal operating currents can pass between the two materials through the junction.

Other features and many of the attendant advantages of the invention are set forth in or rendered obvious by the following detailed description which is to be considered together with the accompanying drawings wherein.

Figure 1:
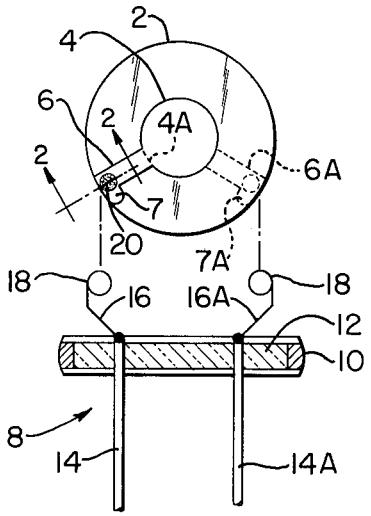
FIG. 1 is an exploded elevational view, partly in section, of a conventional quartz crystal resonator with aluminum contacts for use in a crystal controlled oscillator.
Figure 2:
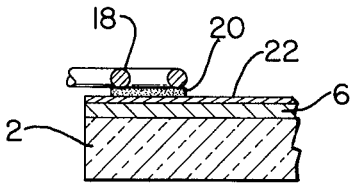
FIG. 2 is a partial cross-sectional view on an enlarged scale taken along 2—2 of FIG. 1.

The phenomenon of an oxide film formed on an electrically-conductive material and existing in an electrical path through an electrical junction is illustrated in FIGS. 1 and 2, which show the essential components of a conventional quartz crystal resonator having aluminum contacts. The resonator comprises thin quartz plate 2, typically of circular shape, having on one side thereof an aluminum electrode which comprises round section 4 disposed symmetrically with the center of plate 2, and tab section 6 which extends to the edge of plate 2 and includes a foot section 7. A second like aluminum contact having round section 4A and tab section 6A having a foot section 7A is formed on the opposite side of plate 2. Header assembly 8 is employed to mount the crystal unit. Header assembly 8 is of conventional design and comprises metallic frame 10 which surrounds and is secured to a round or polygonal plate 12 made of glass, ceramic or other insulating material. Embedded in and extending through plate 12 are two conductive wire leads 14 and 14A and conductively attached to the upper ends of these leads are two conductive metal wire terminals 16 and 16A whose upper ends are formed with open loops 18. In practice the quartz plate is mounted to the header assembly by conductively securing the loops of terminals 16 and 16A to contact tab sections 6 and 6A, respectively. This may be done by soldering, welding or brazing or by means of conductive cement 20 as preferred. By way of example but not limitation, a silver-based cement may be used. In practice the crystal unit is encapsulated by means of a cover (not shown) which is slipped over the crystal unit and sealed to metal frame 10.

Prior to the present invention the aluminum oxide film or layer 22 (see FIG. 2) which naturally formed (or was provided by anodic oxidation) on tab section 6 of the aluminum contact, was scraped with a sharp instrument in the area where the cement 20 was to be applied, in order to expose the aluminum surface therebelow so that the cement 20 would make a good ohmic connection with the aluminum contact. This scraping technique, however, is not entirely satisfactory, particularly with thin film aluminum contacts such as those usually provided on quartz crystals, since removal of too much aluminum metal would degrade the resonator. Further, the pre-scraping procedure subjects the thin quartz plate 2 to unnecessary stresses which could cause crystal fractures and breakage.

In accordance with the present invention, the aluminum oxide film 22 which naturally forms or is formed by anodic oxidation on the aluminum contact is allowed to remain on the aluminum surfaces of the contacts prior to assembly, with cement 20 being applied directly over oxide film 22 preferably leaving a portion of the tab section 6 exposed, as shown in FIG. 2. This particular assembly would normally be unsatisfactory since cement 22 does not directly contact the aluminum surface of tab section 6, but contacts instead the oxide surface film 22 which presents a high resistance that effectively degrades the quality of the resonator and may even render it inoperative.

In accordance with the present invention, the assembled resonator is further treated so that the high resistance effect of the insulating barrier provided by aluminum oxide film 22 is substantially reduced and a relatively low resistance electrical path is provided between cement 20 and tab section 6 of the aluminum contact. Described generally, this further treatment involves passing a controlled current pulse of predetermined magnitude and duration through the oxide film between cement 20 and the aluminum layer therebeneath. More specifically and with reference to FIG. 3, an apparatus is used for providing a pulse of electrical charge through the thin oxide film in order to establish a low resistance ohmic contact. The apparatus comprises a variable D.C. power supply 24 that is capable of supplying a voltage of 15 to 25 volts. The positive terminal of supply 24 is preferably connected to resistor 26, which in turn is connected to one plate of capacitor 28 and to a treating electrode 30. The negative terminal of supply 24 is connected to the other plate of capacitor 28 as well as to system ground. The precise values of the voltage provided by power supply 24, the resistance of resistor 26 and the capacitance of capacitor 28 is dependent upon the particular design of the device being treated as well as the thickness of the oxide film. When treating aluminum-plated quartz crystal resonators similar to the one described in FIGS. 1 and 2, typical values of power supply 24, resistor 26 and capacitor 28 are 20 volts, 10,000 ohms and 150 microfarads respectively. At these values, a typical pulse of electricity discharged through electrode 30 and an aluminum oxide film having a thickness of about 50 Angstroms and given by the equation:

$$Q = V \cdot C$$

Wherein:

Q = the magnitude of charge of the pulse (coulombs);

V = the voltage stored in the capacitor prior to discharge (volts); and;

C = the capacitance of the capacitor (farads);

will have a value of about $3 \times 10^{-3}$ coulombs. Electrode 30 is preferably provided with a sharp needle-like pointed end 32 so that a current pulse can be discharged through a relatively small area of conducting cement 20 and tab section 6.

In accordance with the method of this invention, the device to be treated is assembled so that each electrical junction between two electrically-conductive materials (e.g. between contact section 6 and cement 20) is formed with a high electrical resistance oxide film. Therefore, the quartz crystal resonators shown in FIGS. 1 and 2 are assembled by conductively securing loop 18 of terminals 16 and 16A to contact tab sections 6 and 6A, respectively, using a conductive cement 20. Prior to coupling the apparatus of FIG. 3 to any part of the resonator, the capacitor 28 is allowed to charge as a result of the voltage provided by power supply 24. The amount of time required to charge the capacitor 28 to full potential is a function of the R-C time constant determined by the values of resistor 26 and capacitor 28. After capacitor 28 is fully charged and the crystal resonator unit has been assembled and cement 20 has cured, one of the wire leads 14 is connected to system ground and the needle-like pointed end 32 of electrode 30 is moved into contact with a portion of the contact adjacent the cement 20 so that the charge stored in capacitor 28 is allowed to discharge through electrode 30 and through aluminum oxide film 22 and the aluminum therebeneath, along a path in the aluminum, through the aluminum oxide film 22 beneath cement 20, through the cement and to system ground through the wire lead 14. The process is then repeated by connecting the other wire lead to system ground and similarly moving needle like pointed end 32 of electrode 30 into contact with the portion of the other contact, so that the charge stored in capacitor 28 is allowed to discharge through the aluminum oxide film 22 on that tab 6A beneath cement 20. Preferably, in each instance the electrode 30 is moved into contact with the exposed portion of foot sections 7 and 7A of the respective tabs 6 and 6A of each contact since discharge of the current pulse at the point of contact with the aluminum contact tends to destroy the film at that point. Since foot sections 7 and 7A are nonfunctional in the operation of the resonator, the performance of the resonator will not be appreciably affected. As a result of the electrical discharge through the oxide film, a low resistance ohmic path is created between cement 20 and the aluminum contact therebeneath. Exactly how this result is achieved is not known for sure. However, it is believed that the electrical discharge through the oxide film (which may be referred to as "zapping") electrically disrupts and/or destroys a portion of the oxide film so that an unoxidized portion of the metal electrode is exposed and bonded directly to the cement, whereby a low resistance path is provided between cement 20 and the aluminum contact underneath.

Figure 3:
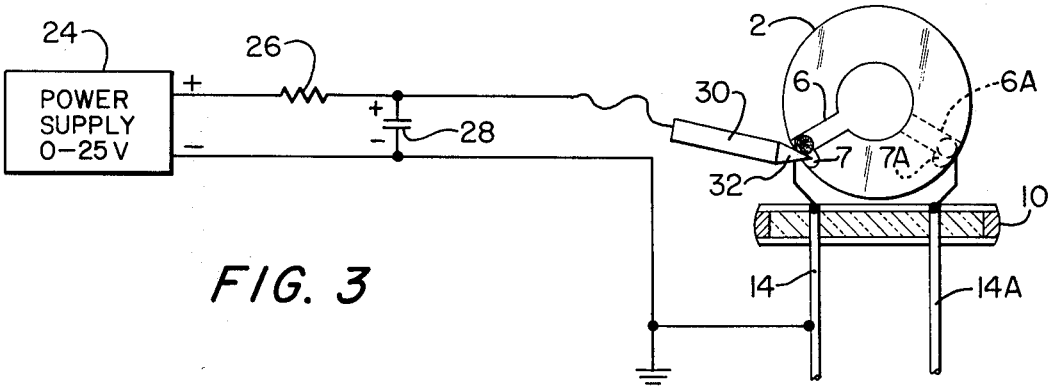
FIG. 3 is a schematic illustration of an arrangement for improving the ohmic contact through an aluminum oxide film to the aluminum surface below, in accordance with the principles of the present invention.
Figure 4:
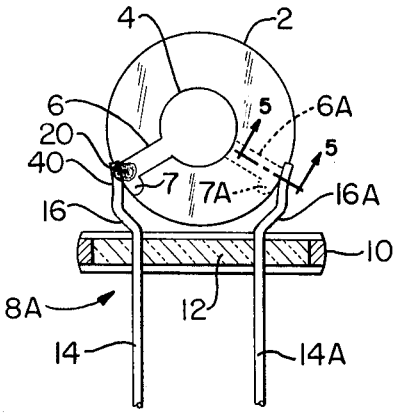
FIG. 4 is an elevational view, partly in section, of a quartz crystal resonator employing a modified leader assembly.
Figure 5:
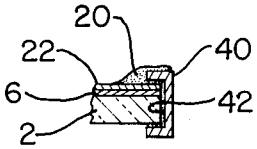
FIG. 5 is a partial cross-sectional view taken along line 5 — 5 of FIG. 4.

The present invention of directing a current pulse through the oxide film makes feasible the use of a modified "header assembly" or "integrated base assembly" 8A shown in FIGS. 4 and 5. Assembly 8A is similar to the header assembly 8 shown in FIGS. 1 – 3, except that the open loops 18 formed at the upper ends of wire leads 14 and 14A are omitted. Instead the upper ends 40 of the wire leads 14 and 14A are each formed with a channel 42 which extends from the upper end 40 toward the frame 10 and plate 12. The channels are each sized and shaped so as to receive the respective edges of the quartz plate 2 provided with tab sections 6 and 6A. The quartz plate is thus mounted to header assembly 8A by conductively securing the upper ends 40 of terminals 16 and 16A to contact tab sections 6 and 6A, respectively. This may be done by soldering, welding or brazing or by means of conductive cement 20 as preferred. As shown, the cement can be provided in channel 42, as well as between tab section 6 and the upper ends 40 of the wire leads. This insures good mechanical as well as electrical connection between the wire leads and the plate 2. Once cement 20 has cured, the pulse of electrical charge can then be provided through the oxide film 22 between the wire leads and the tab section 6 by moving electrode 30, of the FIG. 3 apparatus, into contact with the exposed portion of foot sections 7 and 7A of the respective tabs 6 and 6A of each contact in a similar manner as previously described. As a result of the electrical discharge through the oxide film, a low resistance ohmic path is created between cement 20 and the aluminum contact therebeneath. The advantages of using the header assembly 8A of FIGS. 4 and 5 over assembly 8 of FIGS. 1 and 2 is reduced costs of manufacturing and ease of installation.

The process of electrically discharging the current pulse through the oxide film need only be carried out once. Aluminum contacts electrically treated in this way maintain their low resistance characteristics after extended periods under accelerated aging conditions.

It will be appreciated that the apparatus described in FIG. 3 and the process of using the apparatus can be used with other aluminum plated electrical devices besides the crystal resonator units of FIGS. 1, 2, 4 and 5, such as printed and integrated circuits. In such other applications, the various aluminum contacts and electrodes, each having an aluminum oxide surface film, can be secured to various lead wires or other contacts and electrodes without scraping the oxide film, and the connections thus formed can be "zapped" in accordance with the method of the present invention to provide low resistance ohmic current paths as described above. It is to be appreciated that the power supply voltage and the amplitude and period of the current pulse must be such as to assure that the oxide film is affected as hereinabove described so as to provide a low resistance ohmic path between the device contact or electrode and the lead, contact or other conductive member to which it is connected. The exact magnitude of the voltage and the amplitude and duration of the current pulse may vary in accordance with the thickness and nature of the oxide film. In this connection it is to be understood that the device contact or electrode may be made of a metal other than aluminum, in which case the nature of the oxide may also differ from that of the aluminum oxide film. Also, the conductive cement could be replaced by solder or a brazing alloy, in which case the low resistance conductive path would be formed between the solder or brazing alloy on the one hand and the device contact on the other band.

The advantage of the invention is believed to be obvious. The apparatus of FIG. 3 and the method of using the apparatus improve the electrical conductance through an electrically-insulating oxide film simply by electrically breaking down the film. Further, the resulting low resistance path is formed with speed and relative ease and without scraping the oxide coating and without subjecting the particular electrical devices to unnecessary stresses.

Other advantages and possible modifications of the invention will be obvious to persons skilled in the art.

What is claimed is:

1. A method of making improved ohmic contact between at least one aluminum contact of a quartz crystal resonator and an electrically-conductive material comprising the steps of:

forming an aluminum oxide coating on said aluminum contact;

coupling a wire lead to said contact with said electrically-conductive material; and discharging a current pulse of a predetermined magnitude and duration through said electrically-conductive material and said aluminum oxide coating so as to form a low electrical resistance ohmic path between said aluminum contact and said electrically-conductive material.

2. A method in accordance with claim 1, wherein said electrically-conductive material is an electrically-conductive cement and said step of coupling includes the steps of cementing said wire lead to said contact and curing said cement.

3. A method in accordance with claim 1 wherein the step of discharging an electrical current pulse includes the steps of charging a capacitor with an electrical charge and discharging said capacitor through said electrically-conductive material and said aluminum oxide coating.

4. A method in accordance with claim 1 wherein said step of discharging a current pulse includes the steps of contacting either said electrically-conductive material or said aluminum contact with a needle like pointed end of an electrode and discharging said current pulse through said electrode.

5. A method of making an improved ohmic contact through an aluminum oxide film formed between each aluminum contact of a quartz crystal resonator and a corresponding channeled end of a wire lead of an integrated base assembly supporting said resonator, said method comprising the steps of:

mounting said resonator to said integrated base so that said resonator is received by and conductively secured to the channeled end of said wire lead;

discharging a current pulse through said aluminum oxide film so as to form a low electrical resistance ohmic path between said aluminum contact and said wire lead.

* * * * *